US005769309A

United States Patent [19]

Beneroff et al.

[11] Patent Number: 5,769,309

[45] Date of Patent: Jun. 23, 1998

[54] CUSHIONED BOXES

[75] Inventors: Richard N. Beneroff, Chatham; Jeffrey A. Smith, Clark, both of N.J.

[73] Assignee: Motion Design, Inc., Linden, N.J.

[21] Appl. No.: 604,674

[22] Filed: Feb. 21, 1996

[51] Int. Cl.[6] ..... B65D 5/28

[52] U.S. Cl. ..... 229/167; 229/120.04; 229/120.05; 229/120.17

[58] Field of Search ..... 229/120.04, 120.05, 229/127, 167, 168, 23 R, 142, 120.17, 152, 153; 206/485, 564, 587, 591

[56] References Cited

U.S. PATENT DOCUMENTS

| | | | |
|---|---|---|---|
| 2,321,145 | 6/1943 | Jones | 229/167 X |
| 2,450,941 | 10/1948 | Crane | 229/120.04 |
| 2,614,746 | 10/1952 | Frankenstein | 229/167 |
| 2,693,309 | 11/1954 | Giroux et al. | 229/120.04 |
| 2,939,622 | 6/1960 | D'Ippolito | 206/485 |
| 3,002,672 | 10/1961 | Kotowick | 229/167 X |
| 3,764,004 | 10/1973 | Forbes, Jr. | 206/45.14 |
| 3,968,923 | 7/1976 | Bell et al. | 229/167 |
| 4,236,662 | 12/1980 | Roccaforte . | |
| 4,341,339 | 7/1982 | Zone | 229/167 X |
| 4,396,145 | 8/1983 | Ditton | 229/120.04 X |
| 4,438,848 | 3/1984 | Montealegre et al. | 206/588 |
| 5,029,709 | 7/1991 | Faulstick | 229/167 X |
| 5,240,176 | 8/1993 | Akers | 229/155 |
| 5,372,259 | 12/1994 | Suzuki et al. | 206/586 |
| 5,540,330 | 7/1996 | Lo Duca | 206/446 |

*Primary Examiner*—Gary E. Elkins
*Attorney, Agent, or Firm*—Kenyon & Kenyon

[57] ABSTRACT

An integrally cushioned box includes a plurality of panels collectively bounding an accommodation space for accommodating at least one item. At least some of such panels have integrally formed structures for holding the item accommodated in a resilient manner at a distance from the respective panel. Each such holding structure includes for each respective one of the panels an additional panel situated in the accommodation space in an erected condition of the box and connected with the respective panel such as to keep the additional panel at a distance from the respective panel. The distancing of the two associated panels from one another may be achieved by using a distancing flap integral with the respective panel.

16 Claims, 9 Drawing Sheets

FIG. 11
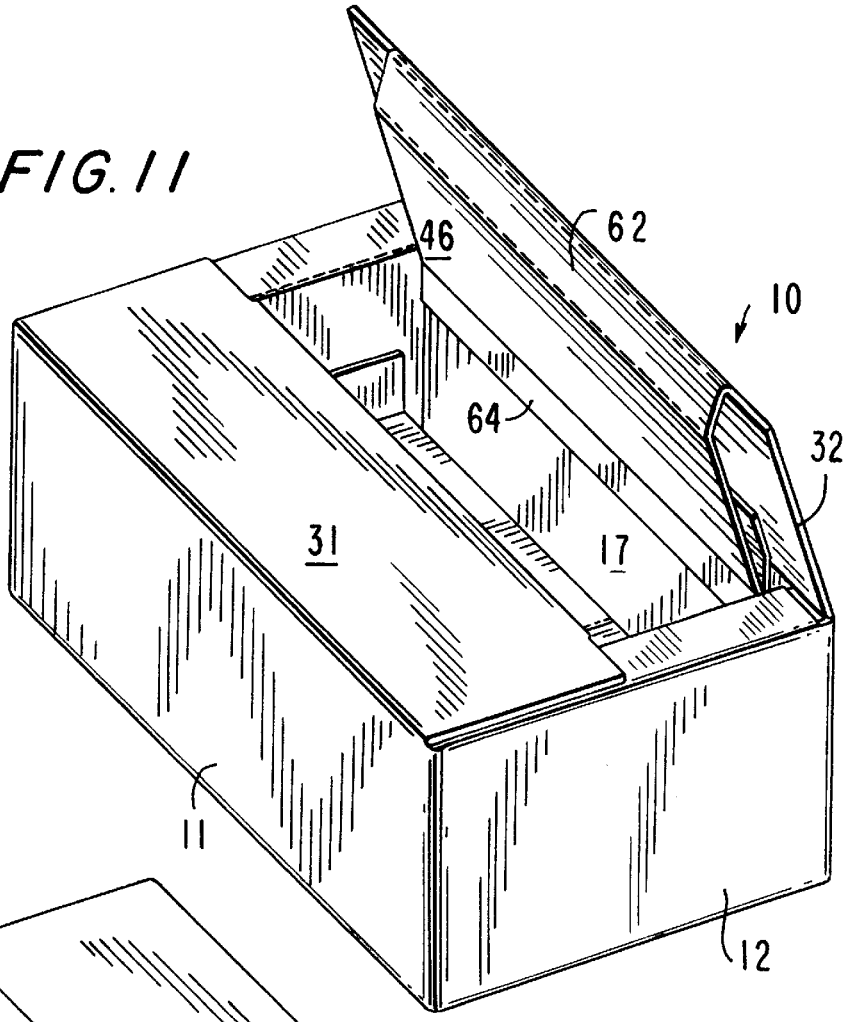
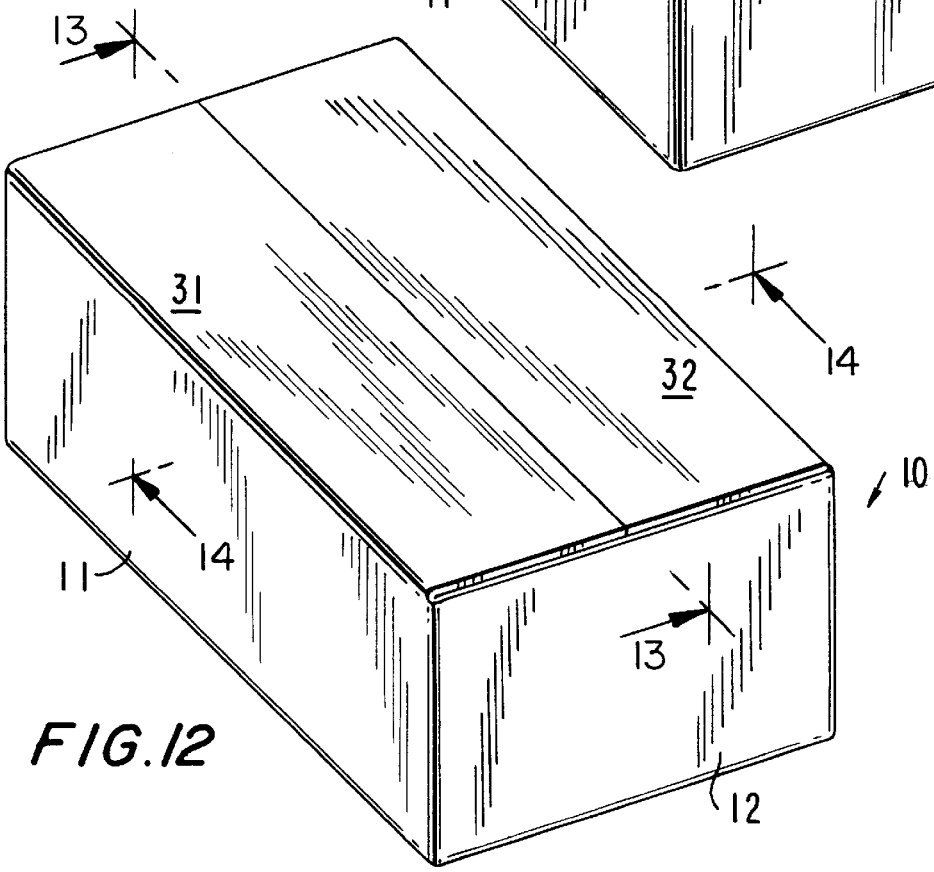
FIG. 12

CUSHIONED BOXES

BACKGROUND OF THE INVENTION

1. Field of the Invention

The present invention relates to packaging in general, and more particularly to packaging boxes for accommodating various items or goods especially during their transportation from a source to a final destination.

2. Description of the Related Art

There are already known various constructions of packaging boxes and similar shipping containers, among them such that are especially equipped in one way or another for the shipping of items or goods therein in a particularly protective manner. So, for instance, sensitive items such as electronic equipment are oftentimes shipped in regular parallelepiped corrugated cardboard boxes but, in order to be protected from potentially damaging shocks and vibrations while in transit, the items are often supported on blocks or specially compatibly, conformingly or complementarily molded formations of foamed polyurethane that hold them at a distance from the panels forming the box and suppress the transmission of any impacts, shocks, vibrations and/or other forces to which the box itself may be subjected while in storage or transit to the item or items accommodated therein.

While this is about the safest way known of protecting the items being shipped, it also contributes not insignificantly to the cost of the packaging material and operation and thus to the cost of the item. Various techniques have been proposed in the past to achieve a similar kind of protection or cushioning in a less expensive way such as using box-shaped cardboard inserts to keep the item at a distance from the box panels, and most of them are still being widely used nowadays, together with such more modern techniques as is the use of foamed polyurethane pellets or beads, or of the so-called bubble-wrap sheets. Experience has shown, however, that all of these approaches have certain drawbacks, be it their cost or the inadequacy of their supporting or cushioning action, or the failure by packing personnel to find or use such cushioning materials.

OBJECTS OF THE INVENTION

Accordingly, it is a general object of the present invention to avoid the disadvantages of the prior art.

More particularly, it is an object of the present invention to provide a cushioned protective container or box that does not possess the drawbacks of the known shipping containers or boxes.

Still another object of the present invention is to devise a cushioned box of the type here under consideration in which the cushioning effect is permanent for as long as the cushioned box is being used, and does not require any special handling in order to be put into effect.

It is yet another object of the present invention to design the above-mentioned protective box in such a manner as to incorporate the cushioning effect right into it.

A concomitant object of the present invention is so to construct the cushioned box of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an integrally cushioned box for accommodating at least one item in an impact and vibration suppressing manner, especially during its transport from a source of such item to its final destination. This cushioned box includes a plurality of outer panels that collectively bound, in whole or in part, an accommodation space for the item. Holding means is provided in accordance with the present invention, for example integrally with at least first and second outer panels that face one another across the accommodation space, for holding the item in a resilient manner at a distance from the respective outer panel when the item is accommodated in the accommodation space. A particular advantage of the arrangement as defined so far is that the holding means, by virtue of being integral parts of the box, cannot be either lost or misplaced, or inserted into the accommodation space in an improper orientation, which problems are known to have been encountered on a rather regular basis in the past when separate inserts were being employed, thus delaying, and increasing the cost of, packaging the item.

It is especially advantageous when the holding means includes, an inner panel situated in the accommodation space in an erected condition of the box, and means for connecting the inner panel with, and for keeping the same at a predetermined distance from, the respective outer panel in the erected condition, thus forming a double wall therewith. In this context, it is particularly advantageous for the connecting means of each of the double walls to include a distancing flap integral with the respective outer panel and inner panel of the respective double wall.

According to another advantageous feature of the present invention, the aforementioned plurality of outer panels may include at least a third outer panel that interconnects the first and second outer panels and partially bounds the accommodation space with them. Under these circumstances, additional holding means similar to the holding means previously described may be provided on the third outer panel. In this scenario, the plurality of outer panels may additionally include a fourth outer panel that also interconnects the first and second outer panels with one another and faces the third outer panel across the accommodation space. Then, there may be further provided on the fourth outer panel still additional holding means similar to the holding means previously described.

It is also advantageous when, in accordance with another aspect of the present invention, the first through fourth outer panels together constitute a unit forming a complete boundary of the accommodation space, thus conferring two open ends on the latter, and when there is further provided at least one closing panel for closing, in whole or in part, at least one of the open ends when in the erected condition. In this situation, it is also advantageous in many instances to provide yet additional holding means similar to the holding means previously described on the closing panel.

A particularly advantageous construction of the cushioned box is obtained when the first through fourth outer panels together constitute a unit forming a complete boundary of the accommodation space, thus conferring open ends on the latter and when two closing panels are provided for closing each of the open ends when spanning the distance between the outer side panels of the unit in the erected condition. Then, yet additional holding means similar to the holding means previously described may be provided on each of the closing panels.

Last but not least, it is advantageous in connection with another facet of the present invention for each of the ends to have a pair of closing panels one of which is integral with one of the outer side panels of the unit and the other with that of the outer side panel of the unit that faces the same, the paired sections complementing each other when in their closed positions with the box being in its erected condition. There may then be provided two pairs of partitioning flaps, each partitioning flap integral with one of the closing panels and forming an extension thereof. One pair of partitioning flaps adjoins the corresponding region of the other of the pair of partitioning flaps when the closing panels are in their closed positions. It is advantageous when the partitioning flaps have respective slots so that the slots of each of the pairs of partitioning flaps receive associated solid portions of the partitioning flaps of the other pair when said partitioning flaps extend into and across the accommodation space in a closed condition of the box to partition the accommodation space into a plurality of compartments.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 11 is a view generally corresponding to that of FIGS. 1 and 7 but showing a further modified form of the packaging box of the present invention;

FIG. 12 is a view generally corresponding to those of FIGS. 2 and 8 but of the packaging box depicted in FIG. 11;

DETAILED DESCRIPTION OF THE PREFERRED EMBODIMENTS

Figure 1:
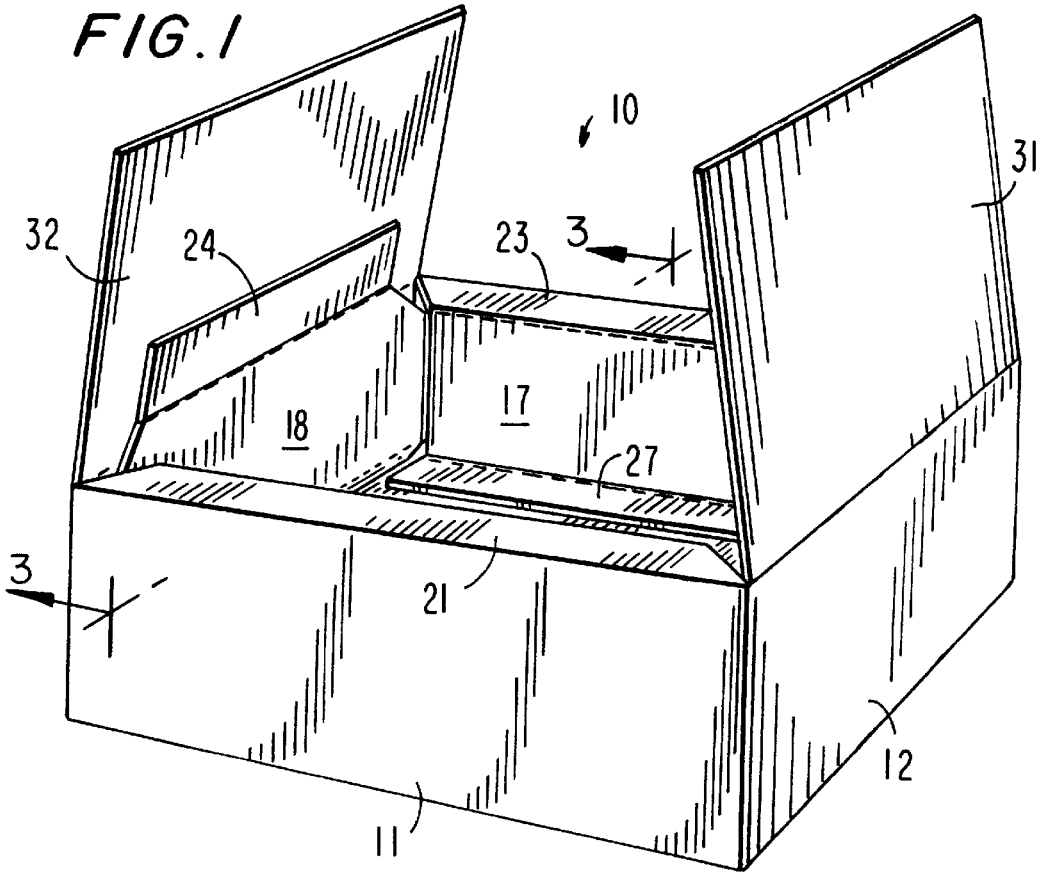
FIG. 1 is a front perspective view of a packaging box provided with a built-in shock suppression feature according to the present invention, in its partially open condition.
Figure 2:
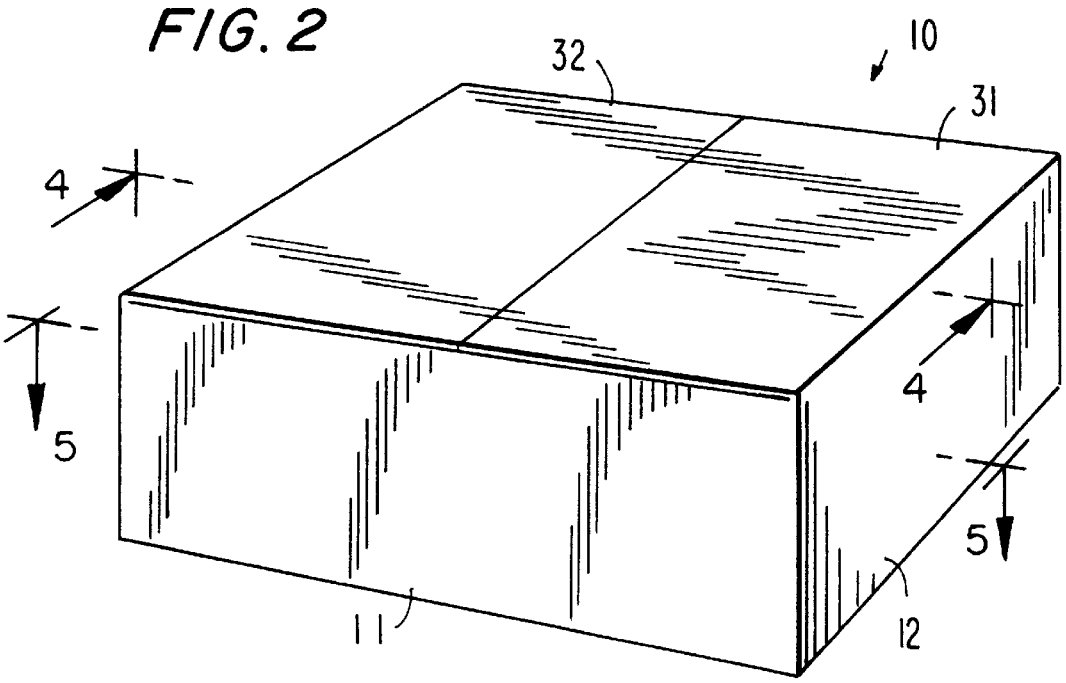
FIG. 2 is a view akin to that of FIG. 1 but showing the packaging box in a fully closed condition.
Figure 3:
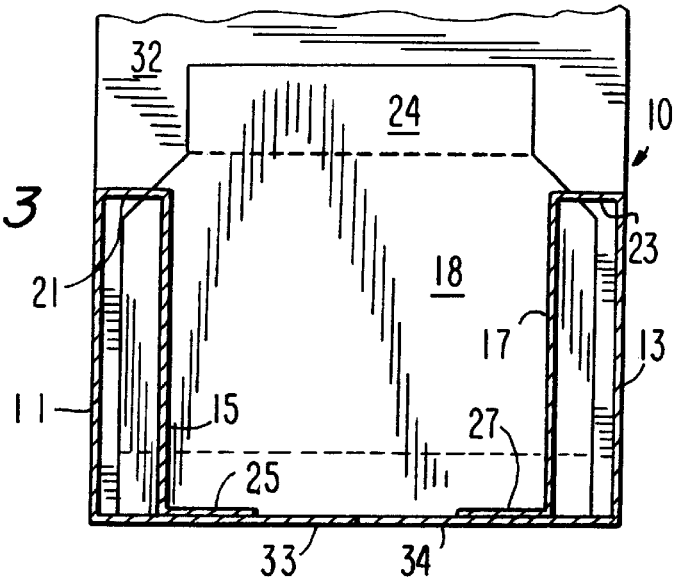
FIG. 3 is a sectional view taken through the packaging box along the plane indicated by and in the direction of the arrows 3—3 in FIG. 1.
Figure 4:
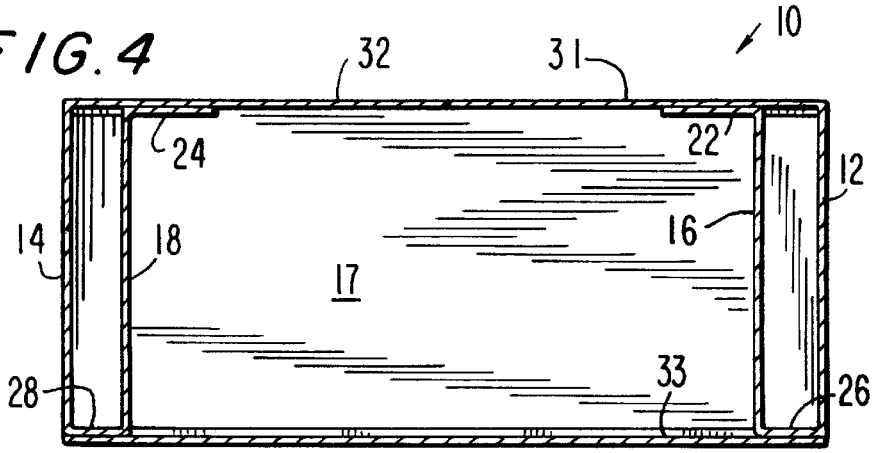
FIG. 4 is a sectional view taken in the plane indicated by and in the direction of the arrows 4—4 in FIG. 2.
Figure 5:
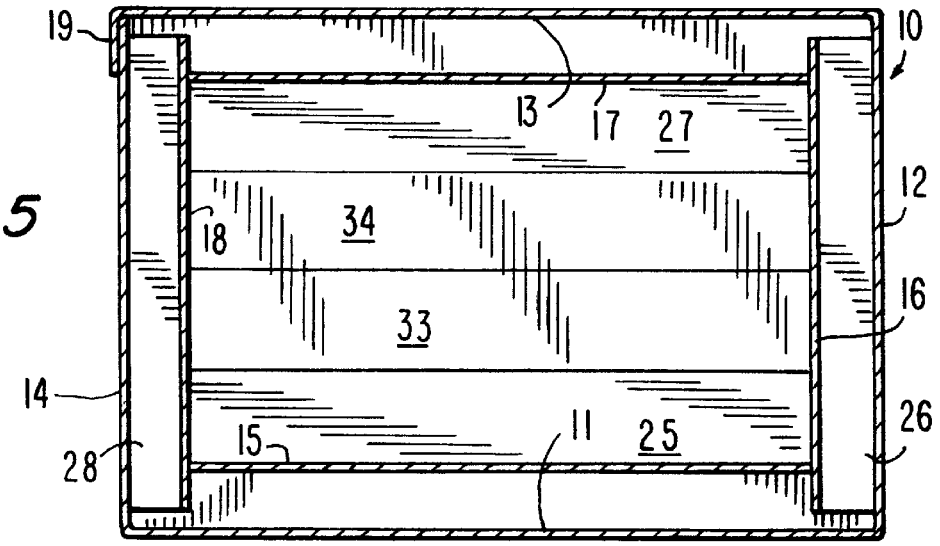
FIG. 5 is a view similar to that of FIG. 4 but taken as indicated by arrows 5—5 in FIG. 2.

Referring now to the drawing in detail, it is to be mentioned first that the same reference numerals are being used therein as well as throughout this description to identify the same or similar but corresponding parts. Thus, for instance, it may be seen that the reference numeral 10 has been consistently used in the various views presented in the drawing for identifying a packaging box incorporating a goods protecting or cushioning feature of the present invention, in its entirety, regardless of the structural details of such a box 10.

When FIGS. 1 to 6 are considered in conjunction with one another, it will be appreciated that the cushioning box 10 of the present invention includes, like many conventional boxes do, a plurality of outer side panels 11 to 14, including a front side panel 11, a back side panel 13, two side panels 12 and 14 interconnecting the front and back side panels 11 and 13, and respective top and bottom outer closing panels 31 to 34. The outer closing panels 31 to 34 span the spaces between the outer side panels 11 to 14 in a closed condition of the box illustrated, for instance, in FIG. 2, and in the illustrated example of the box 10 are constituted by a pair of top outer closing panels 31 and 32, and a pair of bottom outer closing panels 33 and 34, respectively, all as considered in the erected position of the cushioning box 10 that is illustrated in FIGS. 1 to 5 of the drawing. It may also be noted that there is further provided a connecting flap 19 that is integral with the outer side panel 13 and, in the assembled or erected condition of the box 10, overlaps and is joined (for instance glued or stapled) to the outer side panel 14.

However, unlike in the aforementioned conventional boxes, the structure of the box 10 does not stop there; rather, the cushioning box 10 of the present invention is further provided with respective inner side panels 15 to 18 that correspond to the outer side panels 11 to 14, respectively and, in that order, are joined to them in a manner yet to be described, and are spaced from them in the erected condition of the cushioning box 10 to bring about the desired cushioning effect. While the following should be self-evident, it is still to be mentioned at this juncture that this feature, that is, the doubling of at least the side panels by providing the inner side panels 15 to 18 in addition to the outer side panels 11 to 14 and causing them to be spaced from the latter in the erected condition of the cushioning box 10, indeed achieves what it has been set out to do, that is, provides additional protection for the goods to be transported in the box 10 well above and beyond not only what would be available in the absence of the inner side panels 15 to 18 but also what would be obtained if respective cushioning inserts of one kind or another were placed in a conventional box structure after its erection and/or after the placement of the goods to be transported in such a box structure to provide for cushioning of such goods especially while in transport.

As already briefly alluded to before, for the inner side panels 15 to 18 to properly perform their desired protective function, it must be assured that they are, and under all or at least all except catastrophic circumstances remain, spaced from the associated outer side panels 11 to 14. What is meant by "catastrophic" in this context are conditions that are rarely if ever encountered when handling the box 10; a drop of the box 10 filled with goods from, say, two or three feet, albeit still undesirable, may not qualify because it is not all that unexpected in the handling of goods-carrying boxes during their transportation, storage and emptying and was among the reasons why the cushioning box 10 of the present invention was developed in the first place; a drop from a much greater elevation, another crushing blow to the box 10, or a concentrated, piercing-type impact may. Be it as it may, the cushioning box 10 of the present invention is designed to provide a much better protection to the goods being transported therein from the effects of impacts and even vibrations than all that was known and customarily used in this field prior to the present invention.

Figure 6:
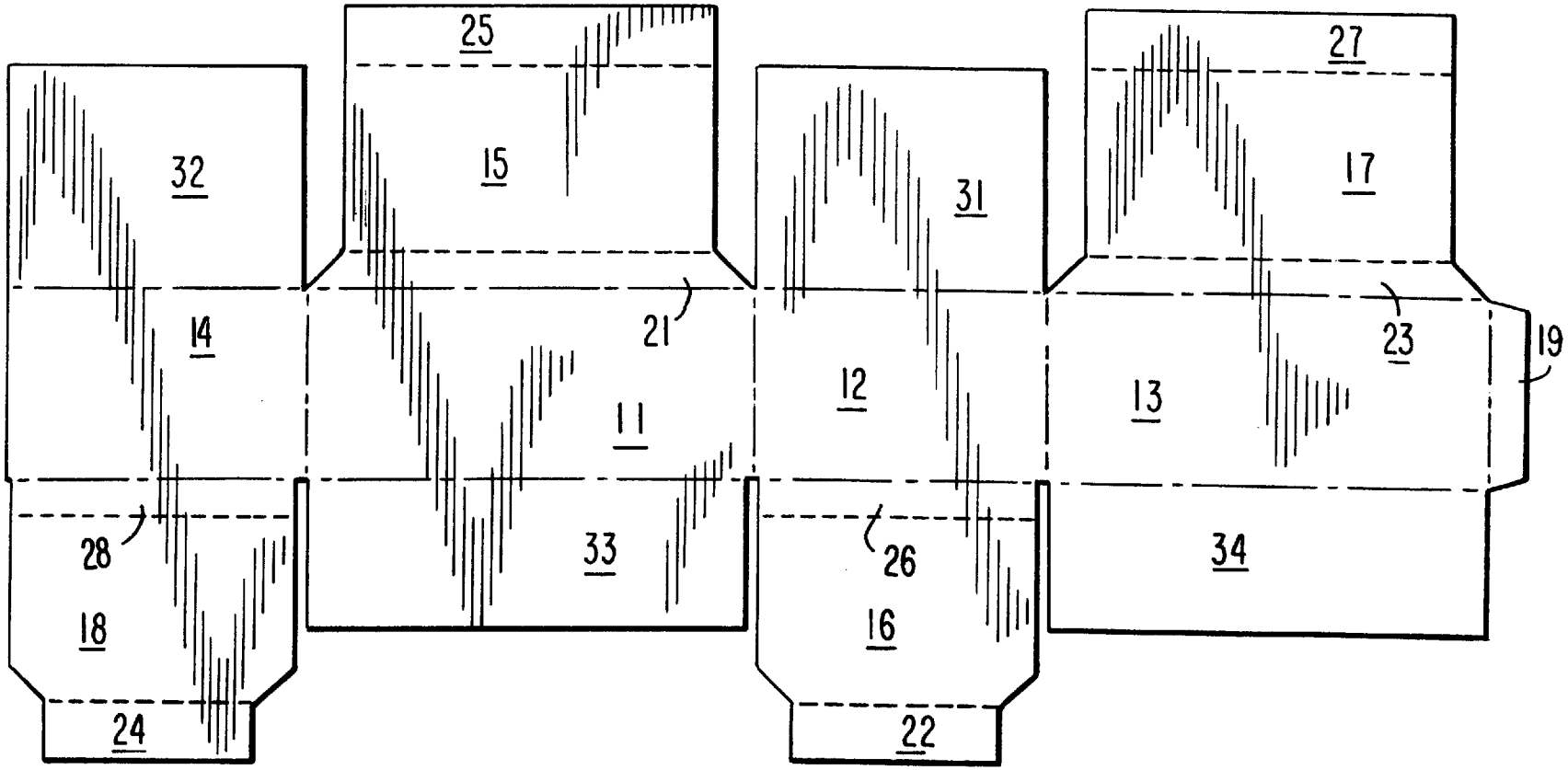
FIG. 6 is a developed view of a preform from which the packaging box of FIGS. 1–5 can be formed by folding and connecting the respective associated portions thereof.

This spacing-apart aspect of the present invention is accomplished by respective parts of the cushioning box 10 that will be collectively referred to as distancing flaps or connecting flaps and that, like the aforementioned outer and inner side panels 11 to 18 and outer closing panels 31 to 34, are constituted by integral parts of a single preform made of corrugated board or any other conventional box-forming material that is shown in its developed, pre-erection, state in FIG. 6 of the drawing. It will be appreciated that, in the erected condition of the cushioning box 10, all of such flaps, which are indicated in the drawing by respective reference numerals 21 to 28 in correspondence with the associated panels 11 to 18, or at least a great number of them, are permanently joined to the adjacent and associated ones of the panels 11 to 18 and/or 31 to 34, either by being integral therewith as the side distancing flaps 21, 23, 26 and 28 are bilaterally, and the connecting flaps 22, 24, 25 and 27 are on one side, or by being glued, stapled or otherwise attached thereto as the connecting flaps 22, 24, 25 and 27 may be and often are to the closing panels 31 to 34, respectively.

On the other hand, in some instances it is not necessary to so permanently connect some of the flaps 22, 24, 25 or 27, and the expense and inconvenience of doing so may be spared. This is especially true about the flaps 22 and 24 that will perform their distancing function well even in the absence of such permanent securing by virtue of merely bracing themselves against the associated side panels 12 and 14. While the flaps 25 and 27 could be shaped and positioned similarly, or one could rely on the weight of the goods being transferred resting on them to hold them in place in their positions illustrated, for instance, in FIG. 3 of the drawing, the aforementioned permanent securing is currently preferred at least with respect to them if not the flaps 22 and 24 as well.

Consideration of FIGS. 1 and 3 to 5, and especially the latter three, in conjunction with one another will reveal that the distancing and connecting flaps 21 to 28 keep the inner side panels 15 to 18 at a distance from their associated outer side panels counterparts 11 to 14 in the illustrated erected condition of the cushioning box 10. As a result of this, the non-illustrated goods or item for the containment of which the cushioning box 10 was designed may merely brace itself against the inner side panels 15 to 18 without any additional protective or cushioning measures having to be taken, and yet be fully protected not only from the effects of vibrations and minor shocks to which the box 10 may be subjected as it is being handled during transportation from one location to another, for instance, but also, to a certain extent comparable to and often exceeding that obtained in heretofore known packaging box constructions, from relatively large shocks and impacts and even from concentrated impacts that may penetrate and damage one or more of the outer panels 11 to 14 but stop short of reaching or piercing the associated one(s) of the inner panels 15 to 18.

These advantages and more are also obtained in the construction of the protective or cushioning box 10 that is illustrated in FIGS. 7 to 10. There is obviously no need to reiterate in connection with this box construction all that has been said before with respect to the construction of FIGS. 1 to 6 and that these two constructions have in common. Suffice it to say that, in addition to the double-walled structure constituted by the full panels 11 to 18, the half-panels 31 to 34, and the distancing and connecting flaps 21 to 28, the box structure of FIGS. 7 to 10 also includes a partitioning or compartmentalization feature that is not present in the previously described box construction.

Figure 8:
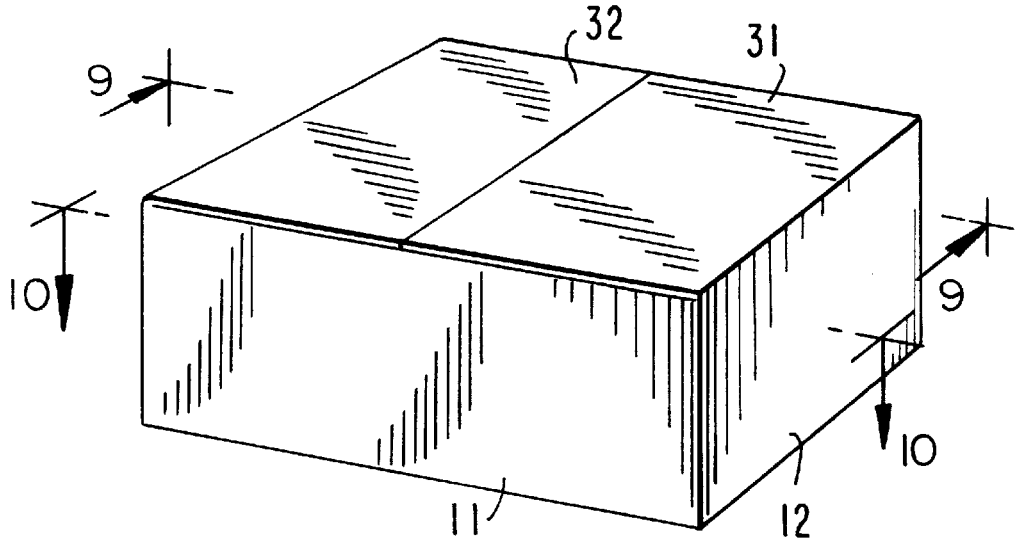
FIG. 8 is a view generally corresponding to that of FIG. 2 but of the packaging box depicted in FIG. 7.
Figure 9:
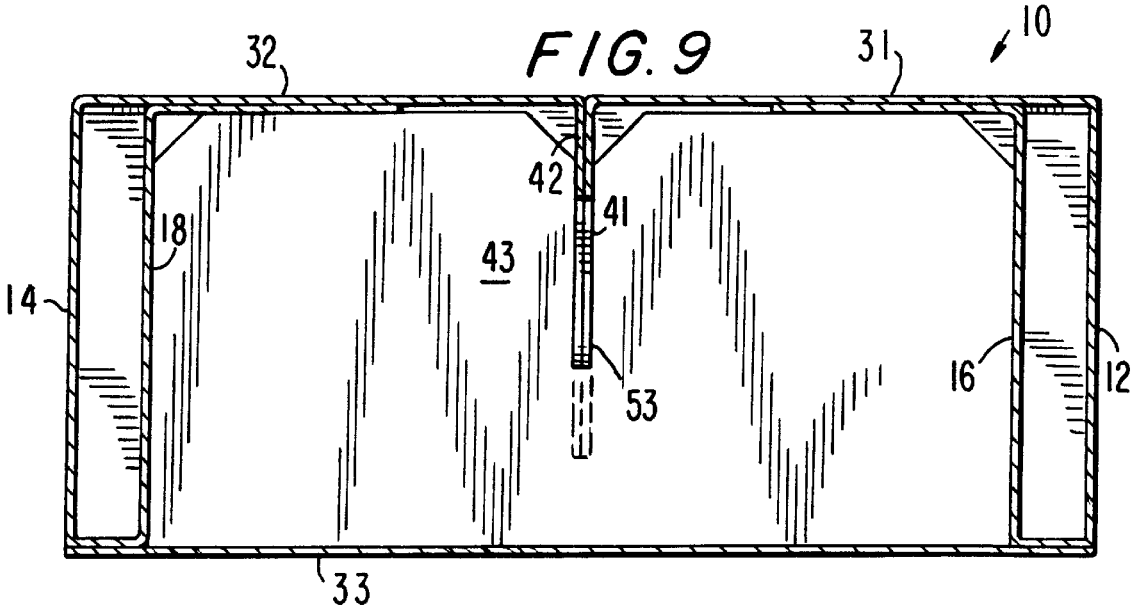
FIG. 9 is a cross-sectional view taken in the plane indicated by and in the direction of the arrows 9—9 of FIG. 8.
Figure 10:
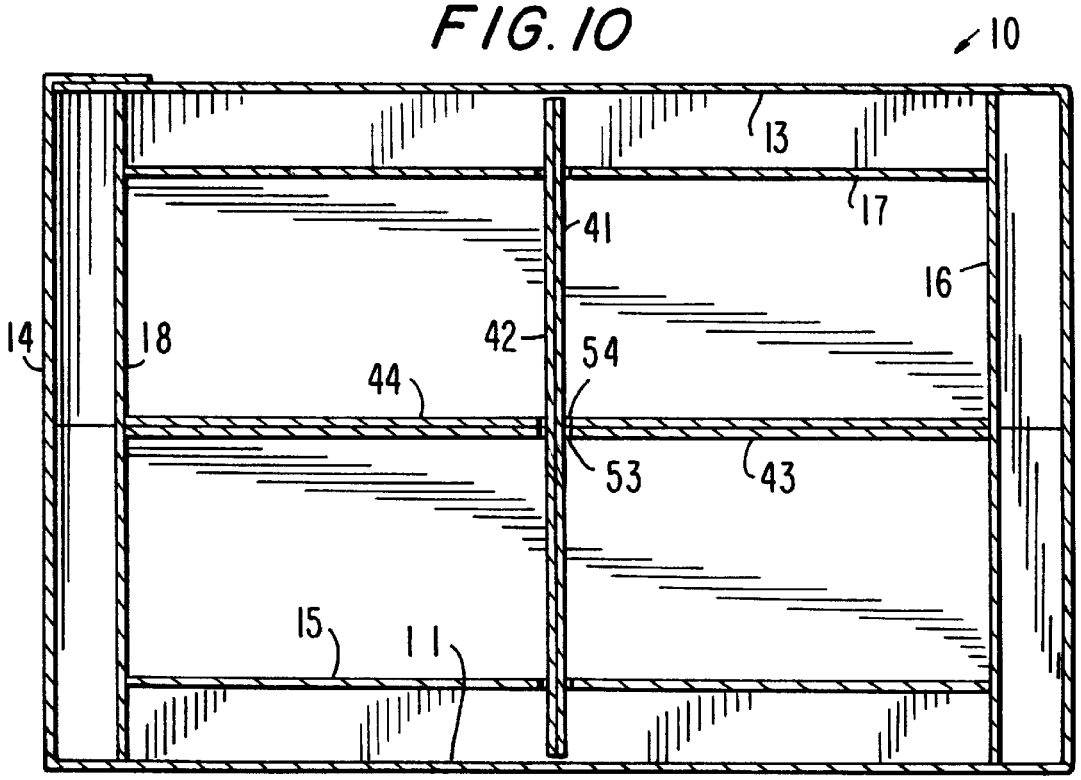
FIG. 10 is a sectional view similar to that of FIG. 5 but taken as indicated by the arrows 10—10 in FIG. 8.
Figure 13:
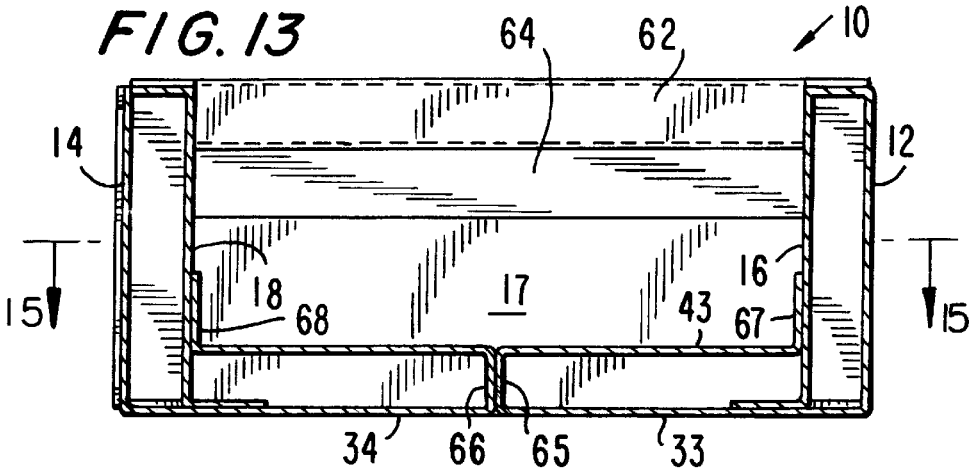
FIG. 13 is a further sectional view taken in the plane indicated by and in the direction of the arrows 13—13 of FIG. 12.
Figure 14:
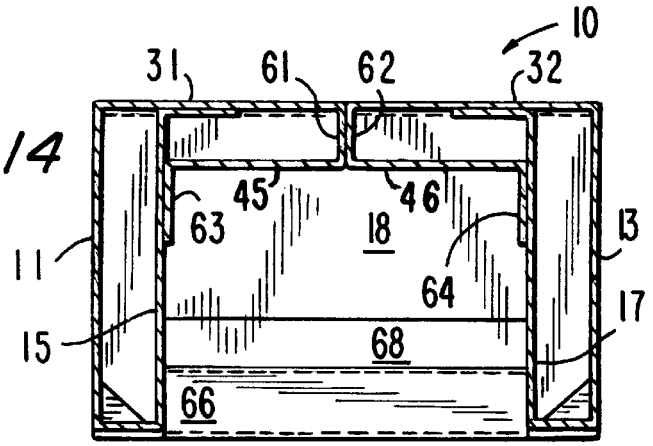
FIG. 14 is a further cross-sectional view taken as indicated by the arrows 14—14 in FIG. 12.
Figure 15:
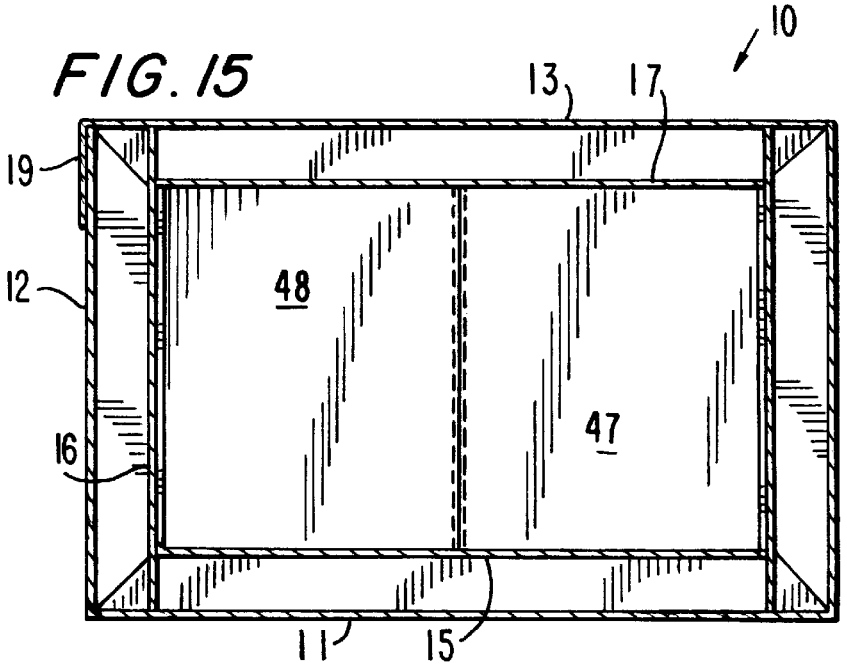
FIG. 15 is yet another sectional view taken through the packaging box of FIG. 11, this time taken from above along the plane indicated by the arrows 15—15 in FIG. 13.

More particularly, additional, partitioning, flaps 41 to 44 are provided that adjoin and are of one piece with the respective associated ones of the top and bottom closing panels, once more as considered in the erected box position illustrated in the drawing. The partitioning flaps 41 to 44 are preferably dimensioned to span substantially the entire distance between the top and bottom closing panels 31 to 34 in the fully closed condition of the box 10 that is shown in FIGS. 8 to 10 of the drawing, and are provided with respective accommodating slots 51 to 54. The slots 51 to 54 extend over substantially one half of the width of the associated partitioning flap 41 to 44, but a different length distribution among the slots 51 to 54 is conceivable and may even be preferred in certain circumstances, so long as the lengths of the adjacent ones of the slots 51, 52 and 53, 54 are substantially the same and the lengths of the slot pairs 51, 52 and 53, 54 add up to the distance between the top and bottom closing panels 31 to 34 in the fully closed condition of the box 10 or slightly less.

It may be observed that in such closed condition of the protective box 10 the partitioning flaps 41 to 44 are interlocked and thus held in position without freedom of movement in any other direction than the box-opening one, and even that one only when accompanied by deformation of the flexible material of the flaps 41 to 44, in that respective portions of the flaps 41 to 44 are received and confined in the associated ones of the accommodation slots 53, 54 or 51, 52. It may be seen that the partitioning walls 41 to 44 subdivide the interior of the box 10 into respective separate compartments each for accommodating one or more of the goods or items to be transported, stored, put on display or otherwise handled while in the box 10, with such separately accommodated goods or items being prevented by the partitioning flaps 41 to 44 from bumping against or otherwise coming in contact with the goods or items contained in the other such compartments.

Figure 7:
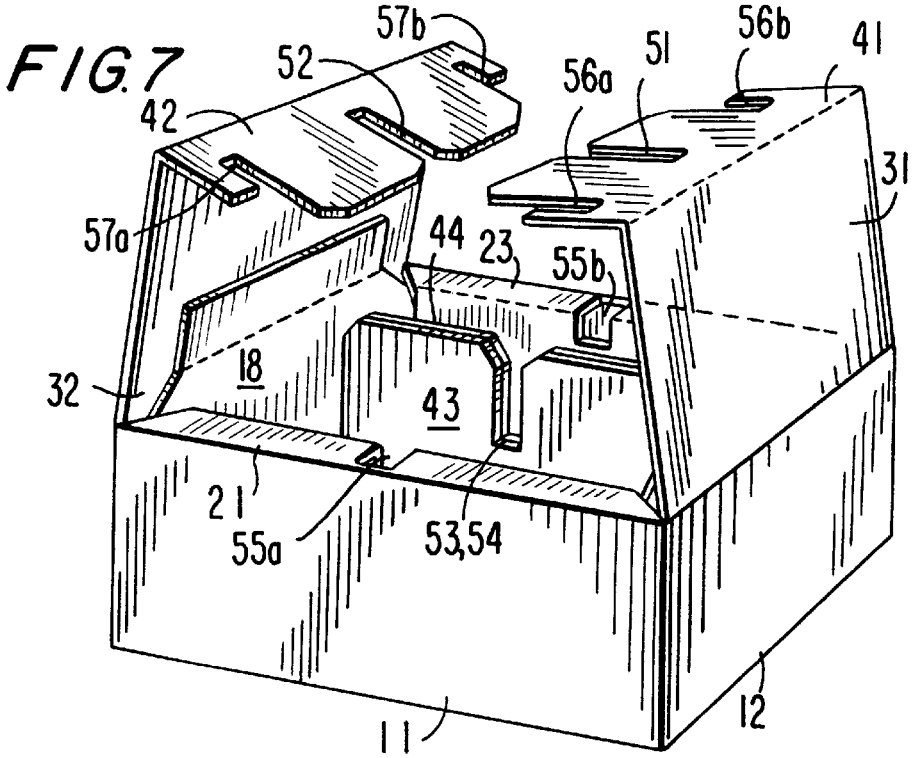
FIG. 7 is a view generally corresponding to that of FIG. 1 but showing a somewhat modified form of the packaging box of the present invention.

What is also shown especially in FIG. 7 of the drawing is that, if so desired, the positional stability of the partitioning flaps 41 and 42 (and, similarly, albeit that is not shown, possibly of the flaps 43 and 44 as well) may be increased by anchoring their respective outer margins in the closed condition of the box 10 to the double walls 11, 15 and 13, 17 (or, in the case of the partitioning flaps 43 and 44, to the double walls 12, 16 and 14, 18). To this end, respective cutouts 55*a* and 55*b* (and/or similar non-illustrated additional cutouts) are provided in the distancing flaps 21 and 23 (and/or 26 and 28, if necessary) and the inner panels 15 and 17 (and/or 16 and 18) for receiving the corresponding portions of the partitioning flaps 41 and 42 (or 43 and 44).

Moreover, to further increase the security of such anchoring, the partitioning flaps 41 and 42 are shown to be provided with respective auxiliary accommodation slots 56*a,* 56*b* and 57*a,* 57*b,* respectively, that flank the slots 51 and 52 and, in the closed condition of the box 10, receive corresponding portions of the inner panels 15 and 17, respectively. A similar additional anchoring feature could also be implemented with respect to the partitioning flaps 43 and 44 and the associated inner panels 16 and 18, but this, like the aforementioned primary anchoring feature, has not been illustrated because it ought to be clear without specific illustration that would just unduly encumber the drawing without any additional benefits being derived therefrom.

Turning now to FIGS. 11 to 15 of the drawing, it may be seen that they illustrate, in addition to the expedients shown in and described above in conjunction with FIGS. 1 to 6 that again will not be discussed here in any further detail, an additional cushioning feature in accordance with the present invention. More particularly, it may have been realized that, while the goods are well protected from all sides in the box constructions illustrated in FIGS. 1 to 10, they may still be vulnerable to some extent to external influences or forces directed against the top or bottom wall of the box 10. Of course, if this a consideration, then the situation may be remedied by introducing appropriately shaped cushioning inserts (may be cushioning sleeves, foamed polyurethane or rubber bodies or beads, and possibly even bubble-wrap sheets) into the bottom and top regions of the cushioned box 10 of that kind.

Yet, in the box structure illustrated in FIGS. 11 to 15, this additional protection is taken care of in the same, relatively simple inexpensive and labor cost saving yet completely reliable manner by giving even the top and bottom walls of the box 10 a double-walled construction. In this case, as a joint consideration especially of FIGS. 11 and 13 to 15 will reveal, inner panels in the form of closing panel inner panels 45 to 48, are being used for doubling the respective top and bottom walls of the box 10. To this end, they are connected to and separated from the associated ones of the top and bottom outer closing panels 31 to 34 by respective distancing flaps in the form of closing panel distancing flaps 61, 62, 65 and 66 integral therewith, and are provided with respective connecting flaps 63, 64, 67 and 68. Without further detailed discussion, it should be clear at this point that the distancing flaps 61, 62, 65 and 66 perform the same function with respect to the outer panels 31 to 34 and inner panels 45 to 48 as their counterparts 21, 23, 26 and 28 do with respect to the inner and outer panels 11 to 14 and 15 to 18.

Figure 16:
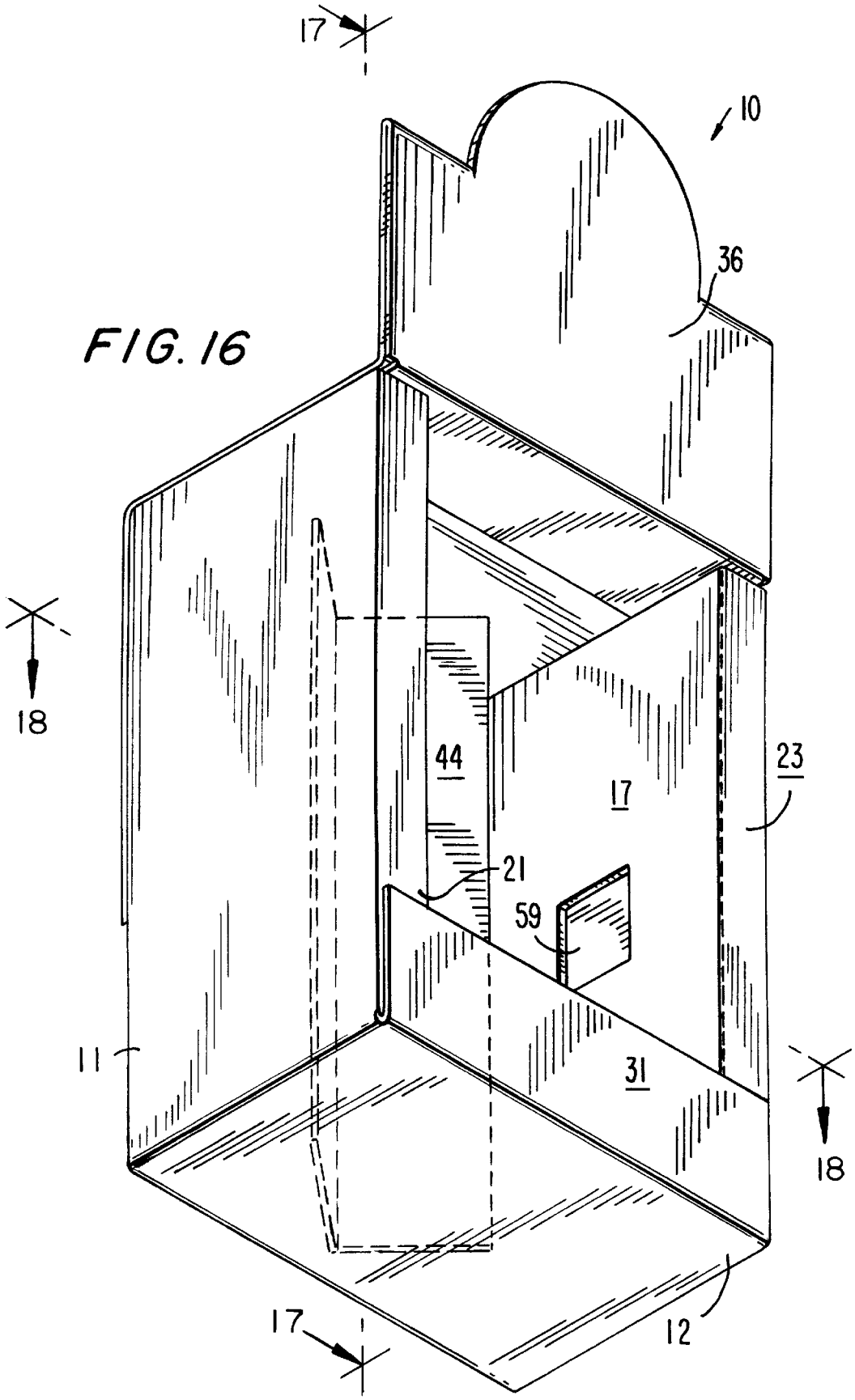
FIG. 16 is a perspective view, partially from below, of a still more modified construction of the packaging box of the present invention in its display condition.
Figure 17:
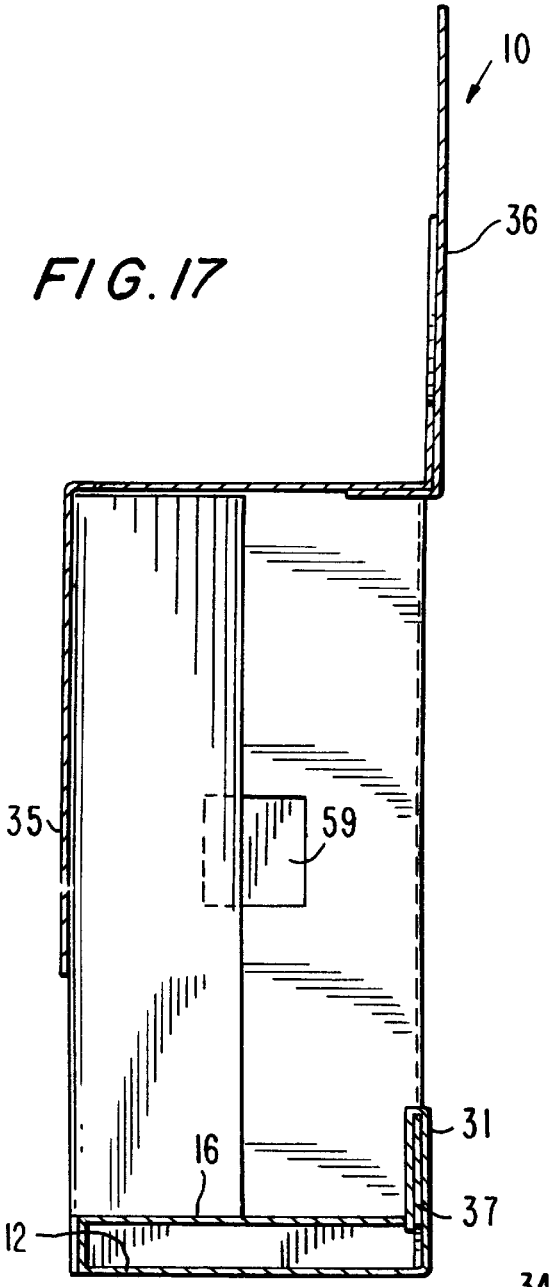
FIG. 17 is a sectional view taken along the plane and in the direction indicated by the arrows 17—17 in FIG. 16.
Figure 18:
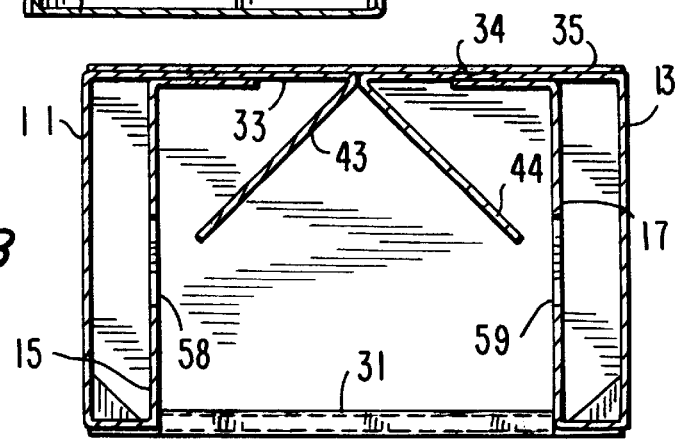
FIG. 18 is a cross-sectional view taken along the plane and in the direction indicated by the arrows 18—18 in FIG. 16.

Last but not least, what is depicted in FIGS. 16 to 18 of the drawing is a construction of the cushioned box 10 that is particularly suited for use in displaying goods or items, preferably those that have been transported to a retail establishment in the box 10 to begin with, on such premises for the clientele to see. In this construction of the box, only three side walls of the box the side and bottom walls of the box 10 as considered in its display position are shown to be doubled. Instead of being used for either partitioning or for wall doubling, the flaps 43 and 44 are being used in this instance, as spacers or back supports for the items on display (not shown).

As also shown, the back wall may be doubled in this case as well, but not necessarily for protection purposes this time, but rather for the purposes of stability. An additional full panel 35 is used for this purpose, being glued or otherwise permanently secured to the outer closing panels 33 and 34 at their back as considered in the illustrated position. Furthermore, the partial panel 32 (or, in its absence, as shown, the reinforcing member or panel 35 which in this instance is extended forward and then upward) may have secured thereto another panel 36 that may carry advertising or other informational or customer-attracting matter or otherwise embellish the otherwise plain box 10 or increase its aesthetic appeal, and positioned in the manner shown in FIGS. 16 and 17 so as not to interfere with free access to the goods on display.

On the other hand, the outer closing panel 31 may be folded, either on itself or, as shown, around a reinforcing strip 37, to also be out of the way as far as access to the goods is concerned, while still providing a rim or barrier that prevents the bottommost goods on display from accidentally sliding or inadvertently being pulled out of the confines of the box 10 in which they are being presented to view. FIGS. 16 to 18 also reveal that cutouts 58 and 59 may be provided at substantially corresponding locations of the inner panels 15 and 17 to facilitate the handling of the box 10 at the display location and/or to provide additional support for the goods on display.

In the aforementioned embodiments, each panel and flap is illustrated as being of a one-piece construction, that is, of a single piece of corrugated board or like box-forming material. In a variant construction, one or more pairs of such panels or flaps, and preferably an opposed pair, is or are formed with cutouts, each cutout being overlain with a taut membrane, preferably a synthetic plastic film that is adhered, fused or otherwise connected around the periphery of the respective cutout.

Figure 19:
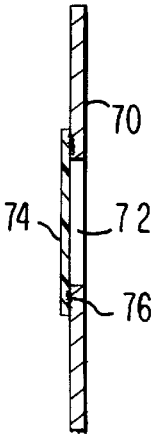
FIG. 19 is a sectional view of a modified panel or flap of the box of the present invention.

Thus, as shown in FIG. 19, a representative panel or flap 70 is formed with a cutout 72, preferably rectangular, which is overlain by a flexible taut membrane 74 that is glued about its periphery to the panel/flap 70. When two or more such membranes are situated within the packaging box, an item therein engages these membranes, thereby further protecting the item from impacts and shocks of the kind encountered during transport and handling of the box.

It will be understood that each of the elements described above, or two or more together, may also find a useful application in other types of constructions differing from the type described above.

While the present invention has been described and illustrated herein as embodied in certain specific constructions of a cushioned packaging and/or display box, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

We claim:

1. A box comprising:

(a) a plurality of outer panels including (1) a plurality of outer side panels bounding an internal space, and (2) at least one outer closing panel connected to a first edge of one of the outer side panels and foldable with respect to that outer side panel to a closed position; and (b) at least one inner side panel and side distancing flap, wherein the side distancing flap is connected to the inner side panel and to a second edge of said one of the outer side panels, the inner side panel is connected to the outer closing panel, and wherein when the outer closing panel is folded to the closed position, the inner side panel is moved toward the center of the box to a distanced position in which it is displaced from said one of the outer side panels.

2. A box according to claim 1 comprising at least a second outer closing panel, wherein the second outer closing panel:

(a) is connected to a first edge of a second one of the outer side panels and is foldable with respect to that second outer side panel to a closed position, and (b) has associated with it at least one second inner side panel and second side distancing flap, wherein the second side distancing flap is connected to the second inner side panel and to a second edge of said second outer side panel, the second inner side panel is connected to the second outer closing panel, and wherein when the second outer closing panel is folded to the closed position, the associated second inner side panel is moved toward the center of the box to a distanced position in which it is displaced from the second outer side panel.

3. A box according to claim 2 wherein each of at least two outer closing panels:

(a) is connected to one of the outer side panels and is foldable with respect to that outer side panel to a closed position, and (b) has associated with it at least one closing panel inner panel and closing panel distancing flap, wherein the closing panel distancing flap is connected to the closing panel inner panel and to the outer closing panel with which it is associated, and wherein when the outer closing panel is folded to the closed position, the associated closing panel inner panel is moved toward the center of the box to a distanced position in which it is displaced from the outer closing panel with which it is associated.

4. A box according to claim 3 wherein one outer closing panel with an associated closing panel inner panel is positioned at one end of the box and another outer closing panel with an associated closing panel inner panel is positioned at an opposite end of the box.

5. A box according to claim 2 wherein one outer closing panel with an associated inner side panel is positioned at one end of the box and another outer closing panel with an associated inner side panel is positioned at an opposite end of the box.

6. A box according to claim 2 wherein one outer closing panel with an associated inner side panel is positioned at one end of the box and another outer closing panel with an associated inner side panel is positioned at the same end of the box.

7. A box according to claim 6 further comprising at least one partition flap connected to an outer closing panel.

8. A box according to claim 1 comprising at least third and fourth outer closing panels, each of which:

(a) is connected to one of the outer side panels and is foldable with respect to that outer side panel to a closed position, and (b) has associated with it at least one inner side panel and side distancing flap, wherein the side distancing flap is connected to the inner side panel and to an adjacent outer side panel, the inner side panel is connected to the outer closing panel, and wherein when the outer closing panel is folded to the closed position, the associated inner side panel is moved toward the center of the box to a distanced position in which it is displaced from the adjacent outer side panel.

9. A box according to claim 8 wherein each of at least two outer closing panels:

(a) is connected to one of the outer side panels and is foldable with respect to that outer side panel to a closed position, and (b) has associated with it at least one closing panel inner panel and closing panel distancing flap, wherein the closing panel distancing flap is connected to the closing panel inner panel and to the outer closing panel with which it is associated, and wherein when the outer closing panel is folded to the closed position, the associated closing panel inner panel is moved toward the center of the box to a distanced position in which it is displaced from the outer closing panel with which it is associated.

10. A box according to claim 9 wherein one outer closing panel with an associated closing panel inner panel is positioned at one end of the box and another outer closing panel with an associated closing panel inner panel is positioned at an opposite end of the box.

11. A box according to claim 8 wherein each of at least four outer closing panels:

(a) is connected to one of the outer side panels and is foldable with respect to that outer side panel to a closed position, and (b) has associated with it at least one closing panel inner panel and one closing panel distancing flap, wherein the closing panel distancing flap is connected to the closing panel inner panel and to the outer closing panel with which it is associated, and wherein when the outer closing panel is folded to the closed position, the associated closing panel inner panel is moved toward the center of the box to a distanced position in which it is displaced from the outer closing panel with which it is associated.

12. A box according to claim 8 wherein a first pair of outer closing panels with associated inner side panels is positioned at one end of the box and a second pair of outer closing panels with associated inner side panels is positioned at an opposite end of the box.

13. A box according to claim 12 further comprising at least one partition flap connected to one outer closing panel of the first pair of outer closing panels.

14. A box according to claim 13 further comprising at least one partition flap connected to one outer closing panel of the second pair of outer closing panels.

15. A box according to claim 14 wherein at least one of the partition flaps has a slot in it for receiving another partition flap.

16. A box according to claim 13, wherein one of the distancing flaps has a cutout in it for receiving a portion of a partitioning flap.

* * * * *

UNITED STATES PATENT AND TRADEMARK OFFICE

CERTIFICATE OF CORRECTION

PATENT NO. : 5,769,309

DATED : June 23, 1998

INVENTOR(S) : Beneroff

It is certified that error appears in the above-identified patent and that said Letters Patent is hereby corrected as shown below:

On the Title Page, right column at [57], line 13, change "panel" to --panel and the additional panel--;

Column 2, line 67, change "panels one of" to --panels, one of--;

Column 5, line 57, change "panels" to --panel--;

Column 7, line 53, change "box the" to --box 10 (or the--;

Column 7, line 54, change "position are" to --position) are--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,769,309
DATED : June 23, 1998
INVENTOR(S) : Beneroff et al.

It is certified that error appears in the above-identified patent and that said Letters Patent is hereby corrected as shown below:

Page 1, right column at [57]
Line 13, change "panel" to --panel and the additional panel--;

Column 2,
Line 67, change "panels one of" to --panels, one of--;

Column 5,
Line 57, change "panels" to --panel--;

Column 7,
Line 53, change "box the" to --box 10 (or the--;
Line 54, change "position are" to --position) are--.

Signed and Sealed this

Tenth Day of July, 2001

Nicholas P. Godici

*Attest:*

*Attesting Officer*

NICHOLAS P. GODICI
*Acting Director of the United States Patent and Trademark Office*